United States Patent [19]

Kicherer et al.

[11] Patent Number: 5,029,303

[45] Date of Patent: Jul. 2, 1991

[54] SWITCHING DEVICE

[75] Inventors: Robert Kicherer, Oberderdingen; Willi Essig, Boeblingen; Mandred Schwarze, Oberderdingen, all of Fed. Rep. of Germany

[73] Assignee: E.G.O. Elektro-Gerate Blanc u. Fischer, Fed. Rep. of Germany

[21] Appl. No.: 460,242

[22] Filed: Dec. 29, 1989

[30] Foreign Application Priority Data

Dec. 31, 1988 [DE] Fed. Rep. of Germany ..... 3844472

[51] Int. Cl.[5] ..... H01H 37/12; H01H 37/16

[52] U.S. Cl. ..... 337/323; 337/312

[58] Field of Search ..... 337/320, 321, 317, 318, 337/319, 323, 312, 313; 335/273

[56] References Cited

U.S. PATENT DOCUMENTS

| | | | |
|---|---|---|---|
| 2,647,962 | 8/1953 | Batcheller . | |
| 4,274,546 | 6/1981 | Branson et al. . | |
| 4,698,612 | 10/1987 | Koehler | 337/320 |
| 4,701,734 | 10/1987 | Nakano et al. | 337/275 |

FOREIGN PATENT DOCUMENTS

| | | |
|---|---|---|
| 371970 | 5/1974 | Austria . |
| 1123059 | 12/1958 | Fed. Rep. of Germany . |
| 232887 | 3/1974 | Fed. Rep. of Germany . |
| 2414812 | 10/1975 | Fed. Rep. of Germany . |
| 2414813 | 10/1975 | Fed. Rep. of Germany . |
| 2540499 | 3/1977 | Fed. Rep. of Germany . |
| 3606508 | 9/1987 | Fed. Rep. of Germany . |

*Primary Examiner*—Harold Broome

*Attorney, Agent, or Firm*—Eckert Seamans Cherin & Mellott

[57] ABSTRACT

In an electric switching device (1), particularly constructed as a temperature regulator, the resilient switching arm (14) controlled by a hydraulic expansion cell (12) for operating a snap switch (5) is fixed by means of positively engaging snap connections (32) to plate-like support parts (20) of a sheet metal support body (3) of a body (2), the support parts (20) on either side of the switching arm (14) being at right angles to joint axis (25) of arm (14) as lateral bends to a base plate (30) of support body (3) and receive between them an end portion of an insulator (4) carrying the switch (5). This leads to an extremely favourable taking up of forces, so that the support body (3) can be made from extremely thin sheet metal as a relatively elastic component. It also leads to a very simple assembly of the switching arm (14).

42 Claims, 4 Drawing Sheets

SWITCHING DEVICE

BACKGROUND OF THE INVENTION

1. Field of the Invention

The invention relates to a preferably thermal switching device with at least one switch.

2. Prior Art

Such switching devices are more particularly used for controlling or regulating the operation of electrical appliances, preferably electrothermal equipment, such as liquid heaters, e.g. water or deep fat fryer heaters, grilling or roasting plates, baking ovens, etc. German Patents 24 14 812, 24 14 813 and 25 40 499 disclose temperature regulators. The hinged bracket serving as a transmission lever from an expansion element or cell to the switch is fixed by screws to a support part (insulator).

SUMMARY OF THE INVENTION

An object of the invention is to give a high strength or rigidity to a switching device and in particular to its effective components, in the case of a simple construction.

According to the invention at least one support part can be constructed in such a way that is extends along the switching or actuating arm by more than a fifth or a quarter and preferably more than a half of its free length, the support part over most of said extension being located in front of the rear end of the switching arm, i.e. extending from the rear end of the switching arm towards its front end, so that substantially no additional overall length of the body is required for the support part. It is conceivable to form said support part by a transverse or marginal web with a corresponding extension, but preferably at least one support part for the switching arm is located in a plane at right angles to the joint axis and it can e.g. be constructed in web-like or plate-like manner. The switching arm forces act in the plane of the greatest deformation resistance of the support part.

Roughly parallel to the joint axis, the support part could be connected to the remaining body, but its strength in the loading direction is increased if it is connected to the remaining body along a longitudinal boundary located roughly parallel to the longitudinal direction of the switching arm or approximately at right angles to the joint axis.

A particularly simple construction is obtained if at least one support part is provided in the vicinity of said lateral, outer longitudinal boundary, because then the space between said longitudinal boundaries is completely free for receiving the components of the actuator. If there are to spaced, parallel, facing support parts, their reciprocal spacing can be so chosen that the switching arm fits precisely between them and forms lateral protective shields for the reception area. Thus, without any additional components, the reception area can be constructed as a casing area bounded by the shields and on two facing sides by the body and the switching arm.

High strength is obtained if a support part is formed by an e.g. plate-like angle leg, whose angle edge is at right angles to the switching arm, or the body and two support parts can be integrally formed by the legs of a U-shaped support body. Their spacing can approximately correspond to the width of the body and also the switching arm, so that the latter can be roughly as wide as the said body. Thus, a switching arm made from thin sheet metal can have a very flat spring characteristic or a high strength.

Instead of forming support parts by the insulator, they can be formed by at least one component separate from the insulator, e.g. from sheet metal and in particular in the form of a punched bent part. As this support body is greatly stiffened by the support part, it can be made from relatively thin metal sheeting e.g. with a thickness less than 1 mm (0.6 mm), the metal thickness of the support body roughly corresponding to that of the switching arm. In the case of the described and also other switching devices, the switching arm can be connected to the body or to a support part by means of a self-locking and preferably notched or snap connection, which requires neither separate fastening means, nor separate assembly steps, such as bending or squeezing processes. In this way it is easier for robots to assemble the switching device. During operation, loosening of the connection between the switching arm and the body is impossible.

If a reception area formed between the switching arm and the facing body is at least partly opened towards the rear end of the body between the lateral outer longitudinal edges of the switching arm, so that e.g. parts of the actuator located in the reception area can engage in the corresponding opening, said parts can be more compactly housed or made larger without taking up additional space, which once again permits an increase in the length of travel and a higher switching accuracy.

It is advantageous if the insulator made from a ceramic material, such as steatite, can be exposed over a relatively large part of the length of the body or projects over the support body and in the vicinity of the latter can be constructed as a particularly thin plate, continuing roughly over the length of the support body and/or its width. The reception area between the lateral support parts is consequently bounded by an insulating plate on the side facing the switching arm. The sheet metal support body is also used for fixing the switching device to a device shield or the like, a high elasticity resulting from the thin support body. It can therefore absorb fastening deformations without transferring them to the functional parts. The mounting of the switching arm takes place laterally of the body, the fastening thereof taking place on its side remote from the switching arm, so that deformations of the support body need not lead to positional or dimensional changes to the support parts.

The invention is particularly suitable for switching devices with a one-armed lever between the switch pressure point and the actuator. This actuator appropriately operates in a temperature-dependent manner and can also be continuously adjustable by hand, e.g. by means for an adjusting spindle, to different operating temperatures or power levels. It can be a diaphragm or expansion cell connected by means of a capillary tube to a temperature sensor on the electrical appliance. The expansion cell is appropriately located in the reception area with a median axis approximately at right angles to the joint axis or in equiaxial manner with respect to the adjusting spindle, which can act directly on the expansion cell. Thus, said expansion cell can have a large external diameter, because it can partly pass through the window-like opening provided in the switching arm.

BRIEF DESCRIPTION OF THE DRAWINGS

An embodiment of the invention with variants is described in greater detail hereinafter relative to the drawings, wherein are shown.

DETAILED DESCRIPTION OF THE PREFERRED EMBODIMENTS

Figure 1:
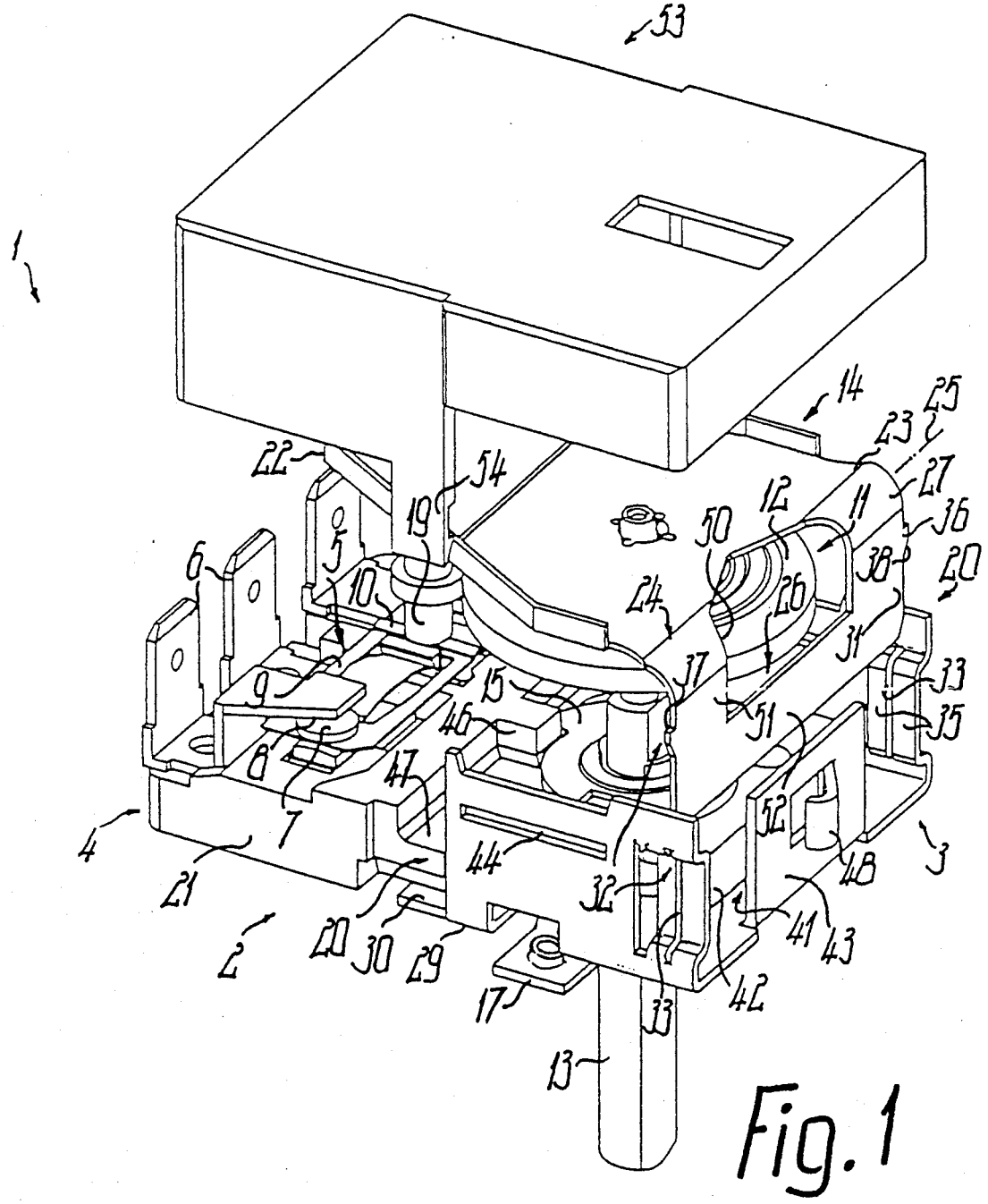
FIG. 1, an inventive switching device in perspective form and with the cover partly raised.

In FIGS. 1 to 6, an inventive switching device 1 has a flat, approximately plate-like body 2, which is constituted by a metallic, approximately U-shaped support body 3, as well as a stepped, plate-like, ceramic insulator 4 fixed thereto and outside the support body 3 carries on one plate side of the insulator 4 an exposed switch 5 in the form of a snap switch. At an end free at right angles to the longitudinal direction of the body 2 and remote from the support body 3 at least two electrical connecting members 6 in the form of flat connecting tongues arranged in a common plane project from the insulator 4 over the plate side carrying the switch 5 and are fixed with angular legs to the associated plate side of the insulator 4 by using screws and serve to electrically connect the switch 5.

Switch 5 carries at the end of a freely projecting contact spring 9 forming a snap spring a movable contact 7, with which is associated a fixed contact 8, if the switching device serves as an on-off switch. Then there are two connecting members. In the case of construction as a reversing switch the movable contact 7 is located between two fixed contacts, with each of which is associated one of three connecting members 6. The elongated contact spring 9 located in a plane roughly parallel to the insulator 4 is only fixed in freely projecting manner by its end remote from contact 7 to the insulator 4 and forms between its ends by means of a transverse corrugation a curved, projecting pressure member 10, by means of which the movable contact 7 is operated.

For the operation of switch 5 is provided an actuator for operating mechanism 11, provided in mechanical series connection as the thermomechanical or thermohydraulic switching member with a flat expansion cell 12 and an adjusting spindle 13 roughly equiaxial thereto and which is approximately at right angles to the plane of insulator 4, being axially adjustably mounted by a thread with respect to the body 2. The end of the adjusting spindle 13 projecting from the plate side of body 2 remote from switch 5 or expansion cell 12 is used for non-rotary connection to an adjusting knob or the like for setting the switching device to different switching temperatures. The other end of the adjusting spindle faces with a spherical end member a central pressure plate on the associated side or on the associated diaphragm shell of the expansion cell. When the switching device 1 is switched off, the end member can be spaced from said pressure plate and otherwise engages thereon.

The expansion cell 12 comprises two diaphragm shells tightly connected at their angular edges and which bound between them a pressure expansion area, so that the expansion cell 12 performs an actuating movement adjustably influenced by the adjusting spindle 13. This is transferred to switch 5 by a flat, e.g. spring steel, freely projecting switching arm 14, which is approximately parallel to the plane of insulator 4 and parallel to body 2. Switch 5 and expansion cell 12 are located approximately in parallel between the insulator 4 and the switching arm 14. Expansion cell 12 is fixed with a projecting nipple located in its axis between the ends of the switching arm 14 and without any additional fastening means by claw-like insertion in an opening directly on switching arm 14, so that it forms a closed constructional unit therewith. The nipple can serve as a connecting nipple for a capillary tube connected to the expansion cell 12 and carrying at the other end a temperature sensor and so as to form a system filled with an expansion fluid. The capillary tube connection can also take place on the other side. Close to its free end the switching arm 14 carries an insulating actuating member 19 for operating the snap switch 5.

Between the expansion cell 12 and the body 2, the adjusting spindle 13 carries an approximately circular disk-shaped adjusting stop 15 prevented from rotating with respect thereto and which has a stop cam projecting over the circumference for limiting the turning path of the spindle 13. The adjusting stop 15 is mounted with a non-circular through opening on a complementary end portion of the adjusting spindle 13 and by a spring simultaneously serving as a stop spring 16 is axially secured in its mounted position, in such a way that said spring slides with pretension on the disk side of the adjusting stop 15 remote from the body 2 and engages said stop 15 against a corresponding ring shoulder of the adjusting spindle or a spindle bearing 18. The spindle bearing 18 passes through the body 2 both in the vicinity of the support body 3 and also the insulator 4 in the form of a bush, which is positionally secured both axially and circumferentially e.g. by claw-like engagement in a through opening of the support body 3. As a result of the described construction the adjusting stop 15 does not perform the axial movements of the adjusting spindle 13 and is instead positioned in an axially displaceable manner with respect to spindle 13. At right angles to the longitudinal direction of body 2 and on either side of the adjusting spindle 13 on the plate side remote from switch 5 tongue-like, offset fixing members 17 with eye-like tapholes are shaped out of the support body 3 and fix the switching device 1 or body 2 to the inside of a shield or the like in such a way that only the slightly resiliently deformable fixing members 17 engage on the opposite face, while the remaining body 2 is contact-free.

In the vicinity of the rear end further removed from switch 5 or connecting member 6 and the side of the operating mechanism 11 remote therefrom are provided on either side and laterally of body 2 and approximately in the planes of the lateral longitudinal sides 21 of insulator 4, two approximately plate-like, substantially parallel support parts 20, which are reinforced by profilings and which substantially extend up to the rear end of body 2 or support body 3 or form said end and extend from the latter forwards only over roughly half the length of body 2. This part is at a maximum half the total length of the body 2 or less. The support plate 20 project beyond the plate side of insulator 4 carrying switch 5 roughly by its thickness and cover the associated areas of its lateral longitudinal sides 21 in such a way that the insulator 40 is positioned in roughly centered manner between the insides of the support parts 20. The free longitudinal edges of the support parts 20 simultaneously project almost to the plane of the switching arm 14, so that they are located laterally on either side of the circumference of expansion cell 12 and at a distance therefrom. The support parts 20 by lateral bends are produced in one piece with the support body 3 from thin metal sheeting. They only lead to an insignificant widening of body 2 compared with insulator 4. The support parts 20 are used for the mounting or holding of the switching arm 14, which in the vicinity of its rear arm end 23 remote from its front, free arm end 22 forms a joint zone 24 located roughly in its plate and having a joint axis 25, which is approximately at right angles to the longitudinal direction of body 2 and is roughly parallel to its plate, so that in the vicinity of the rear end of body 2 it is located on the side of expansion cell 12 remote therefrom. The joint zone 24 is formed by an approximately quadrantally curved bend 27 of the rear end of switching arm 14, which passes into an approximately planar mounting leg 26. The rear end of the switching arm 14, which is approximately trapezoidally tapered in a forward plan view and the mounting leg 26 are approximately as wide as the body 2 or as the internal spacing between the support parts 20, so that leg 26 and therefore also arm 14 are only secured in clearance-free manner by an optionally resiliently fixed position between support parts 22, so as to prevent lateral displacements with respect to body 2. The mounting leg 26 is located on the rear end of body 2 or insulator 4 and in a plane approximately at right angles to that of the body 2, the outside of the leg 26 remote from arm 14 being substantially free.

As a result of the described construction, the support parts 20 are located in planes 28, which are at right angles to the joint axis 25, the support parts 20 extending close to said joint axis 25, so that there is only limited leverage. In addition, each support part 20 is connected by means of a longitudinal boundary 29 to body 2 or support body 3, which is located at right angles to joint axis 25 and parallel to the plane of body 2 and/or in the plane of support part 20 is approximately in the plane of the plate side of body 2 or insulator 4 remote from the switching arm 14, which leads to a very favourable force transfer from support part 20 to the remaining body 2. The support parts 20 are formed by lateral bends of a substantially planar base plate 30 of support body 3, which engages on said plate side of insulator 4 from which are shaped the fixing members 17 and with respect to which is fixed the spindle bearing 18. Thus, the support body 3 surrounds on both sides the associated longitudinal part of insulator 4, the support body 3 being fixed to the insulator 4 by screws or the like engaging in internal tapholes of the base plate 30 engaging in substantially whole-area manner on insulator 4 and forms therewith a closed constructional unit, optionally together with the spindle bearing 18 and the switch 5. The adjusting spindle 13 can be screwed into this constructional unit from the base plate 30, after which the adjusting stop 15 and locking or stop spring 16 are inserted and finally the unit comprising switching arm 14 and expansion cell 12 are pretensioned by a snap connection and positively secured in clearance-free manner.

The lateral marginal areas 31 of the mounting leg 26 form strip-like plug-in members for insertion in plug-in slots 33, which are provided in the vicinity of the rear end of body 2 or support parts 20, in such a way that they are located in a common plate approximately at right angles to the plate plane of body 2 or approximately parallel to the joint axis 25 or even approximately in the joint axis 25.

The slots 33 extending at right angles to the plate plane of body 2 could be formed by open grooves on the insides of the support parts 2, but are appropriately formed by breaks of support parts 20. Each slot 39 is consequently slightly inwardly displaced with respect to the plane 28 of the associated support part 20 through being bounded on either side by strip-like web projections 35 shaped out of the support part 20 by offsets. The web projections 35 are connected to the remaining support part 20 by both ends via the sloping offsets and form profilings, which contribute to a further stiffening of the support part 20. The plug-in slots 33 extend approximately over the entire length of the web projections 35, including their offsets, or over most of the height of the associated support part 20.

A locking cam 36, constructed in one piece with the switching arm 14, projects from the lateral edges of the mounting leg 26 or its marginal areas 31 and forms on its side facing the switching arm 14 a locking shoulder 37 projecting approximately at right angles to support part 20 and an insertion bevel 38 on the side remote therefrom. A corresponding insertion bevel 38 is also provided on each side of the free end of the mounting leg 26. For the assembly of the switching arm 14, the mounting leg 26 is inserted between the free longitudinal edges of the support parts 20 in the plane of slots 33 and is laterally and automatically oriented or aligned by the insertion bevels 39 optionally running up onto the longitudinal edges of the support parts 20, so that simple robot assembly is also possible. When the insertion bevels 38 of locking cams 36 run up against the free longitudinal edges of the support parts 20, the latter are resiliently spread outwards, the end of mounting leg 26 already engaging and consequently being guided in the plug-in slots 33. The insertion bevels 38 can optionally also run up onto part of the associated offset continued in the vicinity of the associated slot end between the web projections 35 until they come into the vicinity of slots 33. Thus, the support parts 20 resiliently spring back and consequently block the cams 36 in such a way that the switching arm 14 is positively secured in the direction opposite to the insertion direction. Therefore the associated slot ends of slots 33 form opposite shoulders 40 for the locking shoulders 37 of locking cams 36. In the insertion direction, switching arm 14 is secured on the other slot ends by corresponding striking of the mounting leg 26.

In the assembled state, at least the free end of the mounting leg 26 is located in a groove-like free space 41, which is bounded by the rear end face 42 of insulator 4 and a rear crossleg 43 of support body 3. This crossleg 43, which is much narrower than the width of support body 3, is angled from the rear end of base 30 in the same direction as support parts 20. As a result of the thus formed boundary faces of the free space 41, the mounting leg 26 is prevented from bulging, which could possibly occur in the case of a corresponding high loading of the joint zone 24 and could lead to loosening with respect to the support parts 20. The leg 26 can be further reinforced by a U-shaped corrugation.

Support parts 20 mount the stop spring 16 on body 2. Spring 16 is a strip-like leaf spring engaging with somewhat narrower ends in bearing slots 44, which are roughly parallel to the plate plane of body 2 in support plates 20 upstream of the plug-in slots 33 and close to the free longitudinal edges of support parts 20. Between the ends the stop spring 16 is recessed for the passage of the adjusting spindle 13. The resulting longitudinal strips are bent roughly in the center of the length of stop spring 16 in each case so as to form a roughly V-shaped cam. The cam closer to the rear end of body 2 serves as a stop or locking cam 45 for engagement in a corresponding circumferential cutout of the adjusting stop 15 in the neutral or off position of the switching device 1. The other cam located on the opposite side of spindle 13 passes in pretensioned, ski-like manner onto the associated end face of the adjusting stop 15 in each rotation position of adjusting spindle 13 and, like cam 45, maintains stop 15 resiliently in its axial working position. With the stop cam of the adjusting stop 15 is associated a counter-stop 46 on the associated side of body 2 and which is appropriately formed by a projection of insulator 4 and is located on the side of the stop 15 remote from the rear end of body 2 or between said stop and switch 5. The insulator 4 shown only in dot-dash line manner in FIG. 5 in the vicinity of support body 3 forms in the vicinity of the latter a reduced thickness insulating plate 47 traversed by the spindle bearing 18, at which the plate side facing the switching arm 14 passes via a step having the counter-stop 46 into the remaining part of the insulator 4 located outside the support body 3 and whose front end located in the vicinity of said step roughly coincides with the front end of the base plate 30. Thus, the insulator 4, with its part carrying the switch 5 and the connecting member 6 projects beyond the support body 3.

Figure 2:
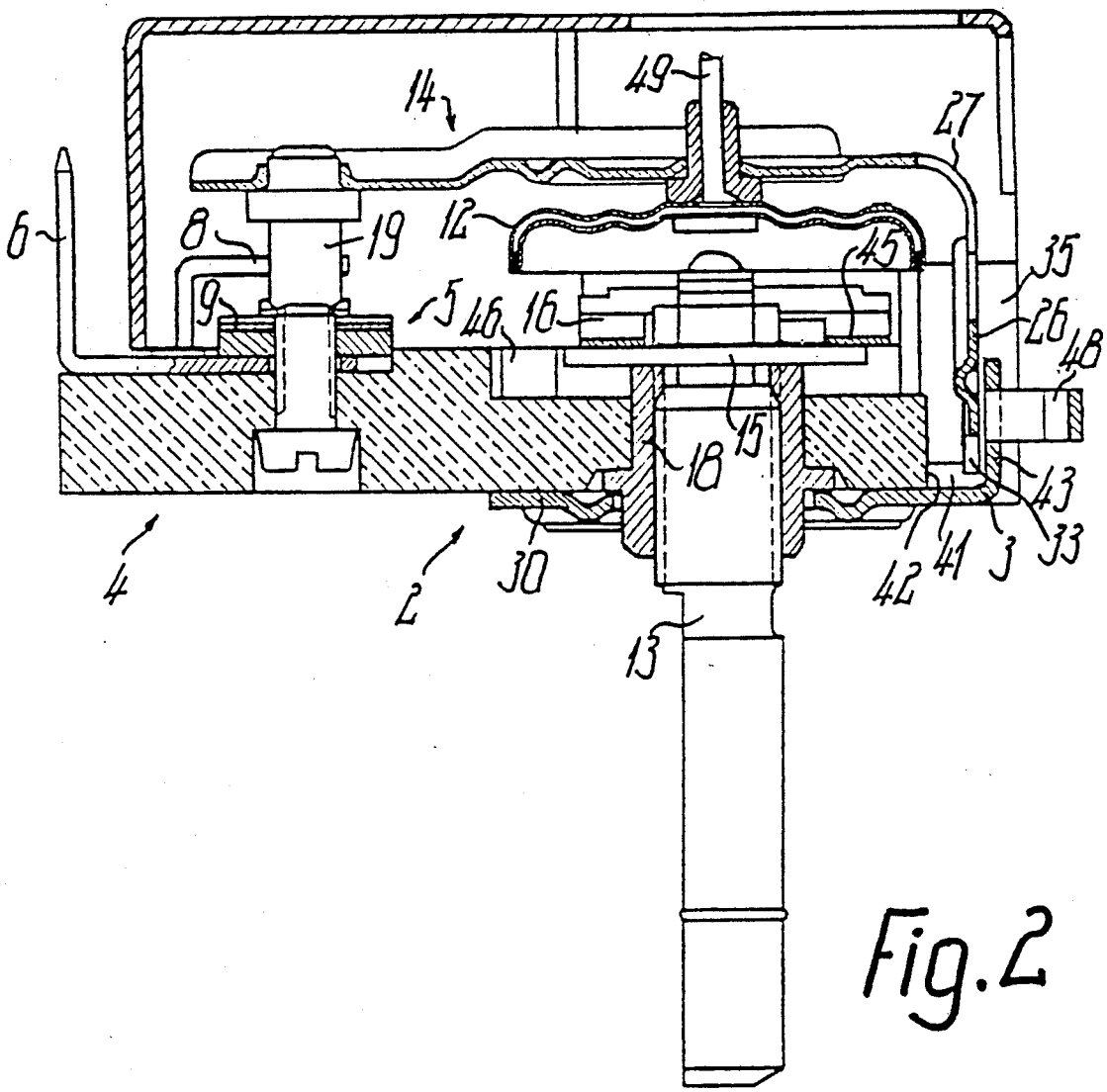
FIG. 2, the switching device according to FIG. 1 in longitudinal section.
Figure 3:
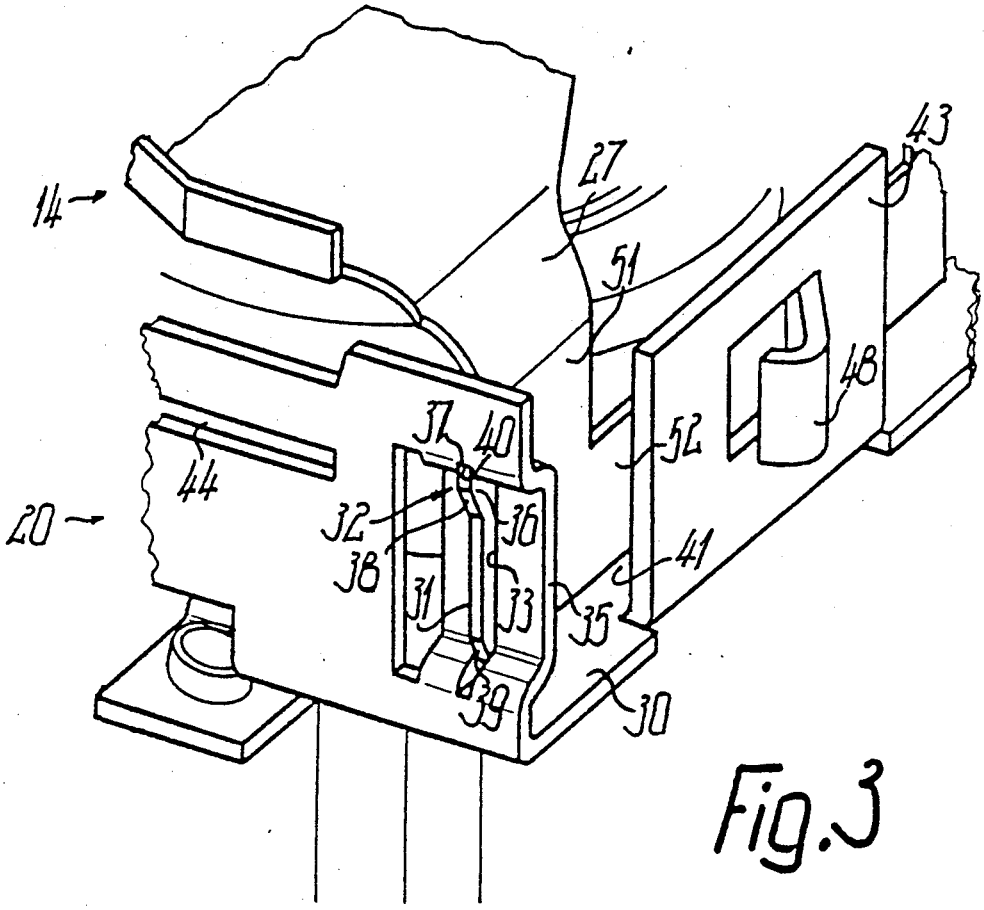
FIG. 3, a detail of FIG. 1 on a larger scale.

A tension relief means 48 for the capillary tube 49 indicated in FIG. 2 can be simply constructionally combined with the crossleg 43, in that from the latter is punched outwards a curved tongue with which the capillary tube 49 led away from the extension cell 12 can be fixed by jamming with respect to body 2, so that any tensile stresses do not act on the connection of capillary tube 49 to expansion cell 12.

Figure 4:
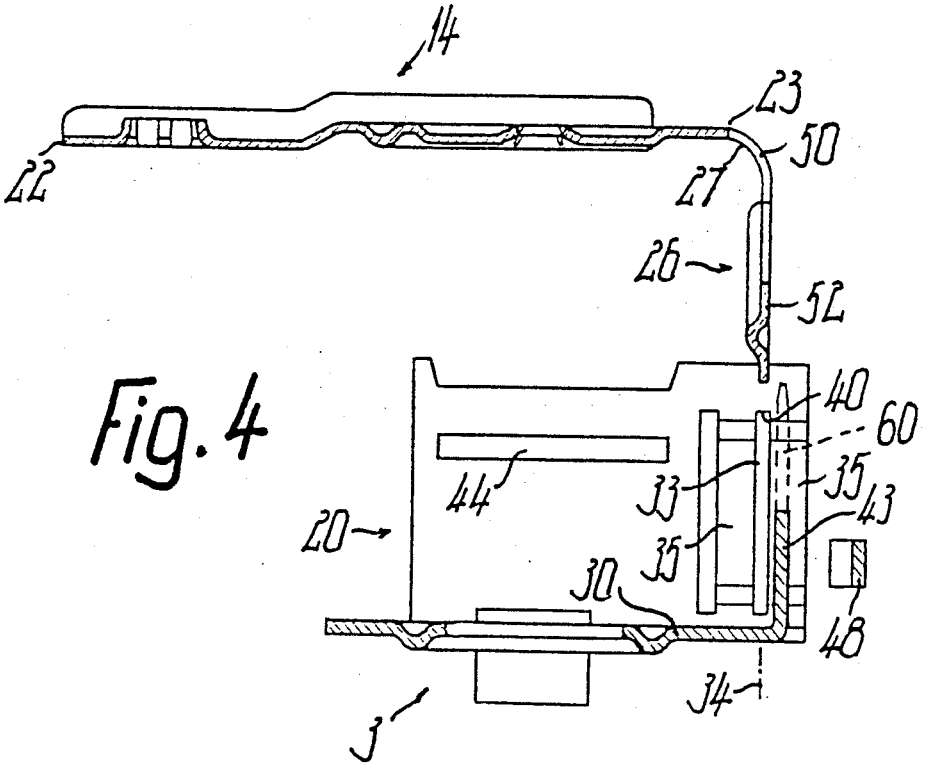
FIG. 4, part of the switching device in longitudinal section according to FIG. 2 and in the not yet assembled state.
Figure 5:
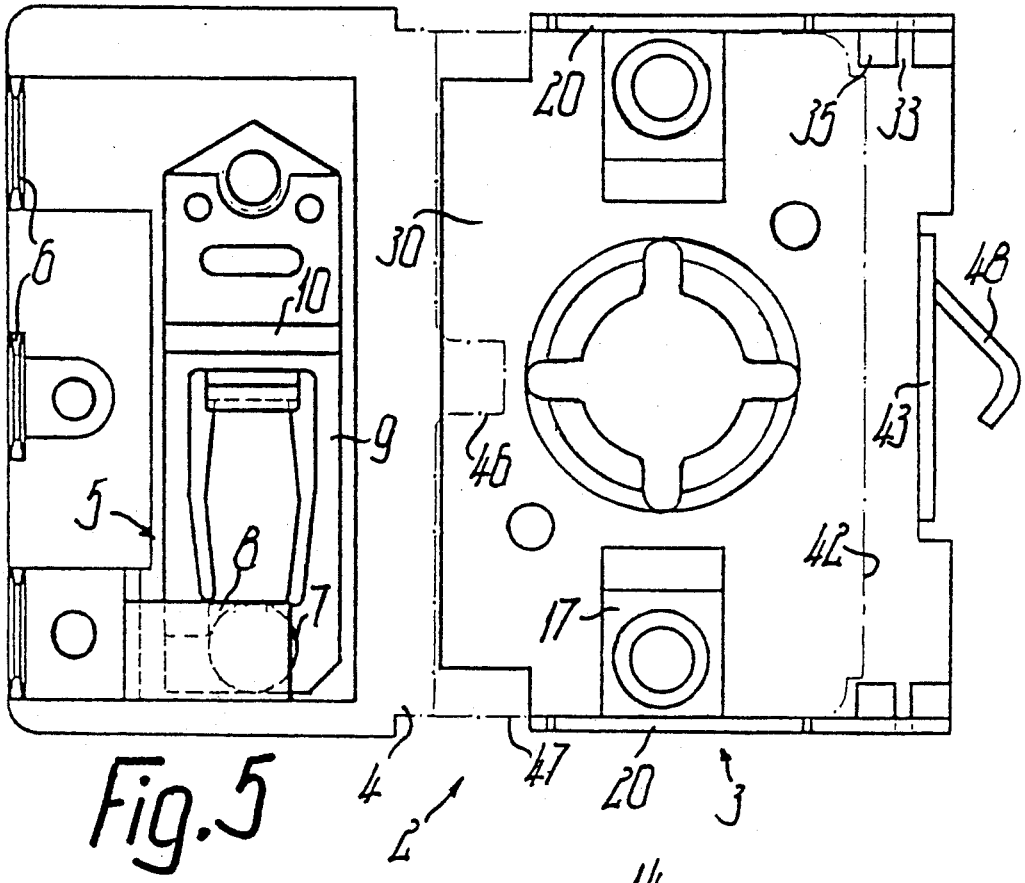
FIG. 5, a view of the inside of the body of the switching device.
Figure 6:
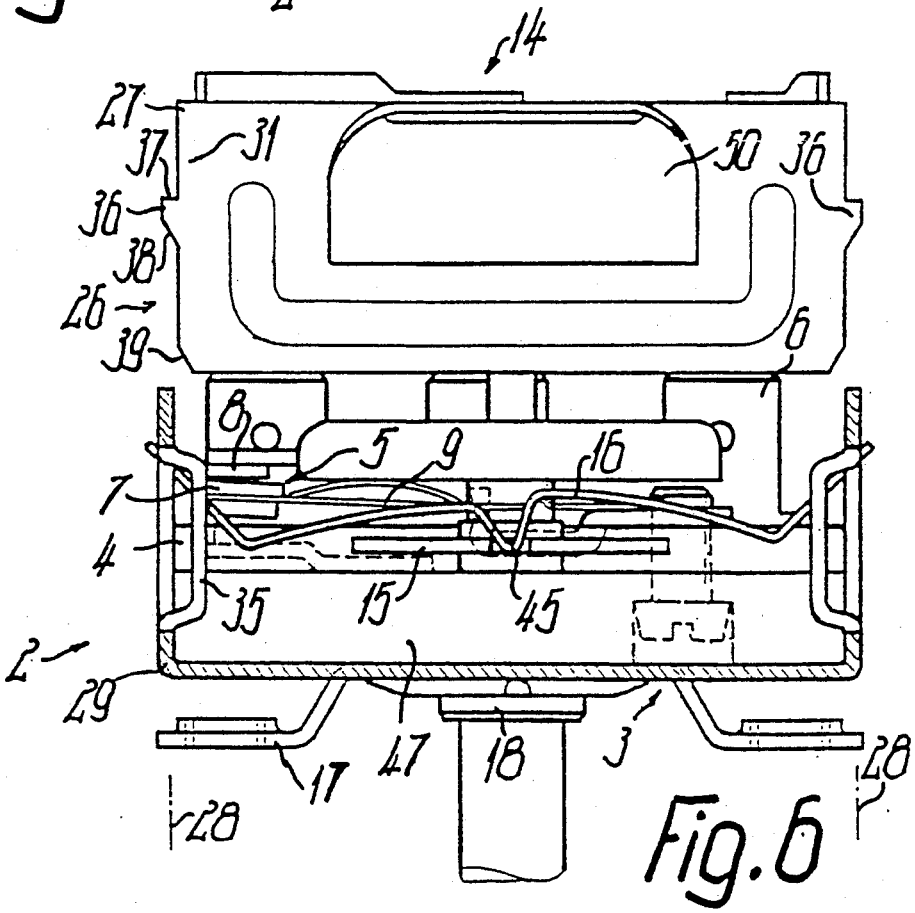
FIG. 6, the switching device in a part sectional view of the rear end and in the still not completely assembled state.

As shown in broken line form in FIG. 4 onto the upper edge of crossleg 43 can be shaped a flat connecting tongue 60 similar to the flat connecting tongues 6, which can be provided for attaching a grounding line for the case that e.g. with a plastic cooker shield grounding is not ensured by the fixing of the regulator.

As is also shown in the drawings, in the vicinity of the rear end of switching arm 14 is provided a window-like opening 50 extending over more than half the width of body 2 and which passes from the rear arm end 23 of switching arm 14, via bend 27 and most of the height of the mounting leg 26, as well as roughly in the center of the width of body 2 or approximately symmetrical to an axial plane of the expansion cell 12 parallel to the longitudinal direction of body 2 and at right angles to its plate plane. The rear circumferential portion of the expansion cell 12 can engage in opening 50, so that a relatively large diameter cell 12 can be housed without enlarging the body 2 or the distance between the engagement point of the expansion cell 12 and the actuating member 19 can be increased for obtaining a greater lever transmission. Opening 50 can e.g. approximately extend up to the free longitudinal edge of crossleg 43. Through said opening 50 the mounting leg 26 is approximately U-shaped, so that it is only connected by spaced lateral legs 51 via bends 27 to the switching arm 14, whilst said lateral legs 51 in their end region further removed from arm 14 are interconnected via a crossweb 52 located in free space 41.

For covering the body 2 on the side carrying the functional parts, namely the operating mechanism 11 and the switch 5, a cover 53 is provided (FIGS. 1 and 2), which brings about an external encapsulation for all the parts which are important for the working functions of switching device 1 and which are sensitive to loading and is made from an insulating material, particularly plastic. By means of tongue-like snap members 54 projecting over the cover edge and located between the ends thereof roughly in the center of the length of the body, said cover 53 can lock directly into the body 2, particularly into insulator 4. Snap members 54 are connected directly to the front ends of the support parts 20 and the outsides of snap members 54 or the associated outsides of cover 53 are roughly aligned with the outsides of support parts 20. Cover 53 can only pass over part of the height of the support parts 20. The inwardly displaced plug-in slots 33 ensure that the lateral marginal areas 31 of mounting leg 26 do not project over the outsides of the support parts 20.

We claim:

1. A switching device comprising:

a base body having at least one insulator and a base support member;

at least one switch arranged at least partly on said insulator and having a displaceable operating contact;

at least one operating mechanism for said switch, said operating mechanism having a resilient switching arm for operating said operating contact, the switching arm being rigidly mounted on said support member substantially in a vicinity of a hinge zone defining a hinge axis, said support member projecting transversely to said switching arm, wherein at least one support member is provided for substantially rigidly holding a mounting section of said at least one switching arm, said support member being generally arranged in a plane oriented transverse to the hinge axis.

2. The switching device according to claim 1, wherein at least one said at least one support member for at least one said at least one switching arm is connected to said base body along a longitudinal boundary parallel to a longitudinal extension of the at least one switching arm.

3. The switching device according to claim 1, wherein two substantially parallel spaced and facing support members are provided.

4. The switching device according to claim 1, wherein two support members are located laterally in the vicinity of outsides of at the least one switching arm.

5. The switching device according to claim 1, wherein at least one said at least one switching arm is mounted with at least one lateral marginal area on at least one said at least one support member.

6. The switching device according to claim 1, wherein at least one said at least one support member, providing a support shield is constructed in a plate-like manner.

7. The switching device according to claim 1, wherein two said support members are formed by legs of a support body substantially U-shaped when seen in a longitudinal direction of at least one said at least one switching arm.

8. The switching device according to claim 1, wherein at least one said at least one support member is constructed as a component separate from said insulator.

9. The switching device according to claim 1, wherein at least one said at least one support member is made from sheet metal.

10. The switching device according to claim 1, wherein at least one said at least one support member and at least one said at least one insulator engage over one another in a longitudinal direction of at least one said at least one switching arm.

11. A switching device comprising:

a base body having at least one insulator and a support member;

at least one switch arranged at least partly on said insulator and having a displaceable operating contact;

at least one operating mechanism for said switch, said operating mechanism having a resilient switching arm for operating said operating contact, the switching arm being mounted on said support member substantially in a vicinity of a hinge zone defining a hinge axis, said support member projecting transversely to said switching arm, wherein at least one said switching arm is mounted on at least one said support member by means of a snap connection having resiliently interengaging snap members.

12. The switching device according to claim 1 or 11, wherein at least one said at least one support member is resiliently arranged in the manner of at least one of springs provided by a gripping spring and a snap spring.

13. The switching device according to claim 1 or 11, wherein at least one said at least one support member has at least one plug-in opening for receiving at least one of said at least one switching arm.

14. The switching device according to claim 13, wherein said plug-in opening is a slot-like through opening defining a median slot plane substantially at right angles to said at least one support member, a longitudinal extension of said plug-in opening being oriented substantially between an angle at right angles and an angle inclined by a few degrees with respect to a longitudinal extension of said at least one switching arm.

15. The switching device according to claim 13, wherein said at least one switching arm tensionally engages opposite edges of at least one said at least one plug-in opening, at least one engaging member of said at least one switching arm being biased around an axis transverse to a longitudinal extension of said switching arm.

16. The switching device according to claim 1 or 11, wherein at least one of said at least one switching arm has at least one locking cam for mountingly engaging at least one of said at least one support member.

17. The switching device according to claim 15, wherein at least one member provided by one of an engaging member and a locking cam is shaped out of a lateral edge of said at least one switching arm.

18. The switching device according to claim 16, wherein at least one said at least one locking cam forms an insertion bevel on a side remote from a locking shoulder.

19. The switching device according to claim 1 or 11, wherein at least one said at least one switching arm is secured by resilient pretensioning in a mounting support.

20. The switching device according to claim 1 or 11, wherein at least one said at least one support member for mounting at least one of said at least one switching arm has at least one mounting projection projecting towards said at least one switching arm.

21. The switching device according to claim 20, wherein at least one said at least one mounting projection is a web projection integrally connected with two end portions to said at least one support member.

22. The switching device according to claim 20, wherein in at least one of said at least one mounting projection, is provided a plug-in slot end located on an end of the mounting projection forming a counter-shoulder for a locking cam of said at least one switching arm.

23. A switching device comprising:

a base body having at least one insulator and a support member;

at least one switch arranged at least partly on said insulator and having a displaceable operating contact;

at least one operating mechanism for said switch, said operating mechanism having a resilient switching arm for operating said operating contact, the switching arm being mounted on said support member substantially in a vicinity of a hinge zone defining a hinge axis, said support member projecting transversely to said switching arm, wherein at least one said at least one switching arm and said base body form a window-like opening in a vicinity of a mounting support for said at least one switching arm and between lateral edges of said at least one switching arm, for receiving an operating member of said operating mechanism.

24. The switching device according to claim 23, wherein said opening is bounded between at least laterally and over an entire circumference by said at least one switching arm.

25. The switching device according to claim 23, wherein said opening is located substantially between support members provided for mounting said at least one switching arm.

26. The switching device according to claim 1, 11 or 23, wherein at least one of said at least one switching arm has on a rear arm end and at an angle at least one mounting leg engaging in at least one of said at least one support member.

27. The switching device according to claim 26, wherein at least one of said at least one mounting leg engages in a slot-like free space between a rear end of said at least one insulator and a rear crossleg of a support body, an angled bend between said at least one switching arm and said at least one mounting leg forming said hinge zone.

28. The switching device according to claim 1, 11, or 23 wherein at least one said at least one insulator has an end remote from said hinge zone of at least one said at least one switching arm, said end projecting freely over at least one said at least one support member.

29. The switching device according to claim 28, wherein said end projects substantially by half of a length extension of said insulator over a support body.

30. The switching device according to claim 1, 11 or 23 wherein at least one said at least one insulator in the vicinity of a support body providing at least one said at least one support member has a reduced thickness, thereby forming an insulating plate.

31. The switching device according to claim 1, 11, or 23 wherein at least one of said at least one operating mechanism has at least one of members provided by a thermoactive switching member and at least one adjusting spindle traversing said at least one insulator between at least two support members, at least one of said at least one member acting between said hinge zone and said at least one switch on said at least one switching arm.

32. The switching device according to claim 1, 11 or 23, wherein an adjusting spindle has substantially inside of said at least one insulator an adjusting stop subject to an action of a stop spring mounted on at least one of said at least one support member.

33. The switching device according to claim 1, 11 or 23, wherein at least one of said at least one operating mechanism has an expansion cell filled with an expansion fluid and loadable by an adjusting spindle, said expansion cell projecting over a rear end of at least one said at least one switching arm and engaging with a circumferential portion into a window-like opening, said switching device thereby operable as a temperature regulator.

34. The switching device according to claim 1, 11 or 23 wherein a grounding flat connecting tongue extending substantially parallel to a crossleg is shaped onto a support body providing at least one said at least one support member.

35. The switching device according to claim 34, wherein said connecting tongue extends from an edge of said crossleg.

36. The switching device according to claim 1, 11 or 23, wherein said switch is an electric switch.

37. A switching device having a switching arm determining a hinged zone, said switching arm having a top portion and a leg, said top portion and said leg defining planes which intersect in said hinge zone to define a hinge axis, said leg rigidly connected to at least one support member of a base body, wherein said at least one support member defines a general plate plane oriented transverse to said hinge axis, and operating means for bringing said switching arm into and out of contact with a switch contact of a switch.

38. The switching device according to claim 16, wherein at least one of an engaging member and locking can is integrally shaped out of a lateral edge of said switching arm.

39. The switching device according to claim 21, wherein a plug-in slot end located on an end of the mounting projection forms a counter-shoulder for supporting a locking cam of said switching arm.

40. A switching device having a switching arm having a top portion and a leg determining a hinging zone, said top portion and said leg defining planes which intersect in said hinge zone to define a hinge axis, said switching arm being mounted on at least one support member of a base body, said support member being arranged in a plane transverse to said hinge axis, said support member connecting in one part to a base plate, said base plate being substantially parallel to said switching arm top portion, operating means for automatically operating said switching arm being provided between a side of said switching arm and said base plate, wherein said base plate is provided on a side of said base body remote from said switching arm, whereby said base body can be positionally adjusted by an inside of said support member extending laterally of and adjacent to said operating means.

41. A switching device having a switching arm determining a hinge zone, said switching arm having a top portion and a leg, said top portion and said leg connecting in said hinge zone to define a hinge axis, said leg being rigidly connected to at least one support member of a base body, wherein said at least one support member defines a general plate plane oriented transversed to said hinge axis, and operating means for bringing said switching arm into and out of contact with a switch contact of a switch.

42. A switching device having a switching arm having a top portion and a leg determining a hinge zone, said top portion and said leg connecting in said hinge zone to define a hinge axis, said switching arm being mounted on at least one support member of a base body, said support member being arranged in a plane transversed to said hinge axis, said support member connecting in one part to a base plate, said base plate being substantially parallel to said switching arm top portion, operating means for automatically operating said switching arm being provided between a side of said switching arm and said base plate, wherein said base is provided on a side of said base body remote from said switching arm, whereby said base body can be positionally adjusted by inside of said support member extending laterally out and adjacent to said operating means.

* * * * *